US008784226B2

(12) United States Patent
Yang et al.

(10) Patent No.: US 8,784,226 B2
(45) Date of Patent: Jul. 22, 2014

(54) INFANT SWING APPARATUS

(71) Applicant: Wonderland Nurserygoods Company Limited, Central Hong Kong (HK)

(72) Inventors: Tao Yang, Central Hong Kong (HK); Man Qun Cheng, Central Hong Kong (HK)

(73) Assignee: Wonderland Nuserygoods Company Limited, Hong Kong (HK)

( * ) Notice: Subject to any disclaimer, the term of this patent is extended or adjusted under 35 U.S.C. 154(b) by 45 days.

(21) Appl. No.: 13/711,238

(22) Filed: Dec. 11, 2012

(65) Prior Publication Data

US 2013/0157770 A1 Jun. 20, 2013

(30) Foreign Application Priority Data

Dec. 19, 2011 (CN) ..... 2011 1 0427939

(51) Int. Cl.
*A63G 9/12* (2006.01)
*A63G 13/00* (2006.01)

(52) U.S. Cl.
USPC ..... 472/118; 472/119; 297/256.16

(58) Field of Classification Search
USPC ..... 472/118–125; 297/273, 281, 283, 284, 297/256.13, 256.14, 256.16
See application file for complete search history.

(56) References Cited

U.S. PATENT DOCUMENTS

| | | | | |
|---|---|---|---|---|
| 5,562,548 | A * | 10/1996 | Pinch et al. | 472/119 |
| 7,258,617 | B2 | 8/2007 | Chen | |
| 7,422,524 | B2 | 9/2008 | Gregorian | |
| 7,445,559 | B2 | 11/2008 | Kakuda | |
| 2011/0070958 | A1 * | 3/2011 | Zhang | 472/118 |

* cited by examiner

*Primary Examiner* — Kien Nguyen
(74) *Attorney, Agent, or Firm* — David I. Roche; Baker & McKenzie LLP

(57) ABSTRACT

An infant swing apparatus includes a support structure, a swinging platform pivotally assembled with the support structure, a plurality of seat anchors affixed with the swinging platform, and a child seat removably held with the swinging platform. The swinging platform is pivotally assembled with the support structure and has a central axis extending from a rear to a front of the swinging platform, the swinging platform being operable to swing back and forth between the rear and the front. The seat anchors include a first and a second seat anchor disposed substantially aligned with the central axis of the swinging platform, and a third seat anchor located at a side of the central axis and in a region between the first and second seat anchors. The child seat can be removably held with the swinging platform by engaging with at least two ones of the first to third seat anchors.

20 Claims, 9 Drawing Sheets

1

INFANT SWING APPARATUS

CROSS-REFERENCE TO RELATED APPLICATION

This application claims priority to Chinese Patent Application No. 201110427939.2 filed on Dec. 19, 2011.

BACKGROUND

1. Field of the Invention

The present inventions relate to infant swing apparatuses.

2. Description of the Related Art

Conventionally, the installation of a child safety seat is required to seat a young child in a vehicle. When it is not used for seating the child in the vehicle, the child safety seat may also be installed on a support structure (such as a swing frame) where the child can be conveniently placed for receiving care. However, conventional design approaches for the support structure only permits the installation of one specific type of the child safety seat on the support structure. In other words, the design of the support structure is limited to one specific type or model of the child safety seat, which makes it inflexible.

Therefore, there is a need for a design that can address the aforementioned issues, and provide a support structure that can accommodate different types of child seats.

SUMMARY

The present application describes an infant swing apparatus that can be installed with different types of child seats. In one embodiment, the infant swing apparatus includes a support structure, a swinging platform pivotally assembled with the support structure, a plurality of seat anchors affixed with the swinging platform, and a child seat removably held with the swinging platform. The swinging platform is pivotally assembled with the support structure and has a central axis extending from a rear to a front of the swinging platform, the swinging platform being operable to swing back and forth between the rear and the front. The seat anchors include a first and a second seat anchor disposed substantially aligned with the central axis of the swinging platform, and a third seat anchor located at a side of the central axis and in a region between the first and second seat anchors. The child seat can be removably held with the swinging platform by engaging with at least two ones among the first to third seat anchors.

DETAILED DESCRIPTION OF THE EMBODIMENTS

Figure 1:
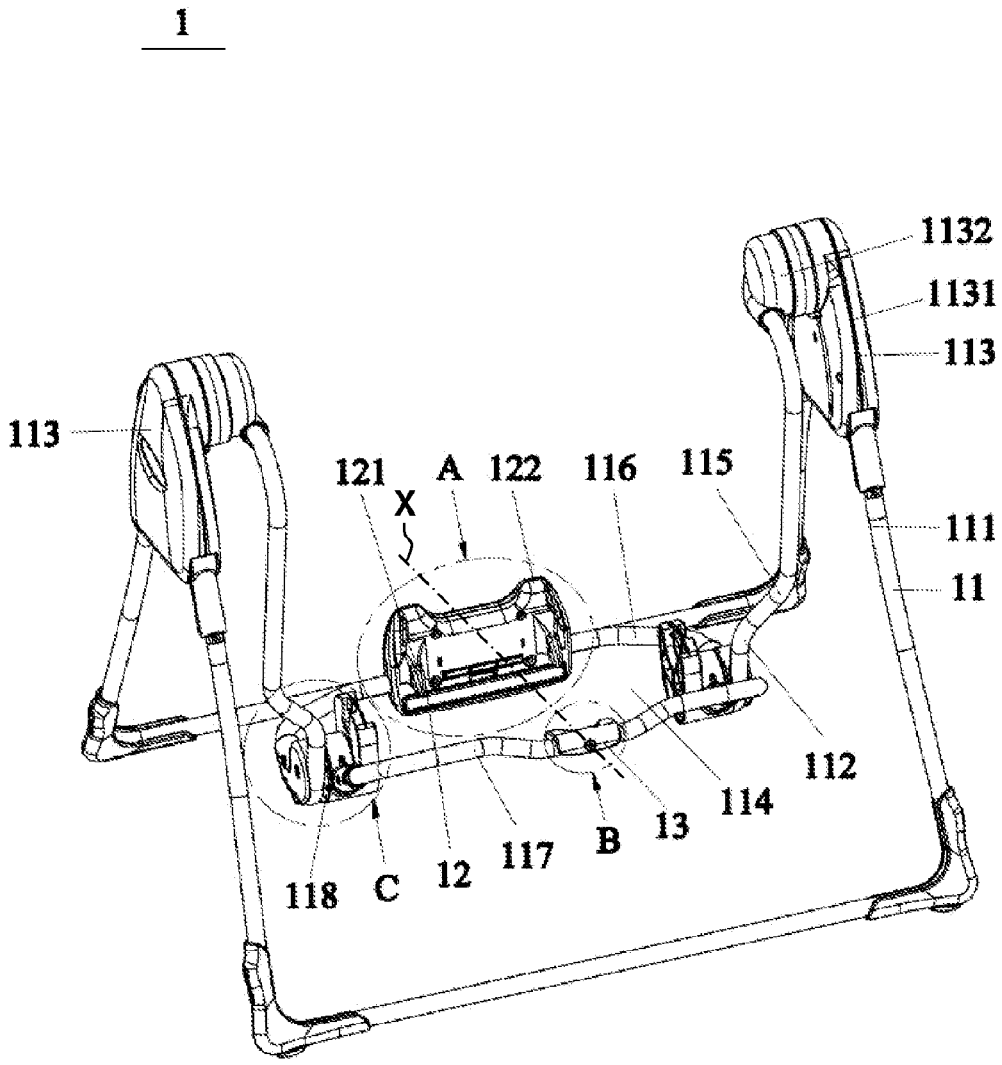
FIG. 1 is a schematic view illustrating an embodiment of a swing frame implemented in an infant swing apparatus.

The present application describes an infant swing apparatus that can be installed with multiple types of detachable child seats. In particular, the infant swing apparatus has a frame structure provided with a plurality of seat anchors adapted to fasten with different types of attachment systems that may be implemented on the child seat.

FIGS. 1-6 are schematic views illustrating an embodiment of an infant swing apparatus including a swing frame 1, and a child seat 2 that can be removably installed with the swing frame 1. The child seat 2 can be a child safety seat used for seating a child in automobile vehicles. When the child seat 2 is used in a vehicle, the child seat 2 may be held on a support base (not shown) that can facilitate the placement of the child seat 2 on a vehicle passenger's seat. To this end, an underside of the child seat 2 may have a latch structure operable to lock and unlock with respect to the support base.

As shown in FIGS. 1-5, the swing frame 1 can include a frame structure 11 adapted to receive the installation of the child seat 2. The frame structure 11 can include left and right side leg frames 111 that form a fixed support structure, a swinging platform 112 disposed between the two leg frames 111, and two pivotal connections 113 through which the swinging platform 112 is pivotally assembled with the two leg frames 111.

Each of the pivotal connections 113 can be similar in construction including a housing 1131 securely affixed with an upper end of one leg frame 111, and a rotary hub 1132 affixed with an upper end of the swinging platform 112 and pivotally assembled with the housing 1131. At least one of the housing 1131 can enclose an electric motor operable to drive reciprocated displacements of the rotary hub 1132 so as to impart a swing motion to the swinging platform 112. In some embodiments, the pivotal connections 113 may also incorporate a music player device for entertaining a child.

The swinging platform 112 can include two swing arms 115, a first tube segment 116, a second tube segment 117, and two joining brackets 118. Each swing arm 115 can have an upper end pivotally assembled with one associated leg frame 111 through one pivotal connection 113, and a lower end connected with one joining bracket 118. The swing arms 115 can impart a back and forth swing motion between a rear and front of the swinging platform 112.

The first tube segment 116 can have two opposite ends respectively affixed with the two joining brackets 118 at the left and right sides of the swinging platform 112. The second tube segment 117 can have two opposite ends respectively connected with coupling shells 119 that in turn pivotally assemble with the joining brackets 118. More specifically, each joining bracket 118 can include a pocket 1182 in which one coupling shell 119 can be received and pivotally connected with the joining bracket 118. In this manner, the second tube segment 117 can be pivotally adjusted with respect to the first tube segment 116 about a pivot axis that extends transversally across the space between the leg frames 111. The assembly of the first tube segment 116, the second tube segment 117 and the joining brackets 118 can surround and delimit a central opening 114, forming a resting support on which the child seat 2 can be installed. This construction of the frame structure 11 can define a motion axis along which the swinging platform 112 can perform back and forth swing motion.

The swinging platform 112 can include multiple seat anchors that are disposed at different locations around the central opening 114. These seat anchors can be compatible and engage with different types of attachment systems that may be provided on the child seat 2. In one embodiment, the swinging platform 112 can include a front seat anchor 12, a rear seat anchor 13, and two lateral seat anchors 1180.

The front seat anchor 12 and the rear seat anchor 13 can be respectively disposed at the front and the rear of the swinging platform 112, and can respectively engage with front and rear portions of the child seat 2 to hold the child seat 2 with the frame structure 11. To provide balanced holding of the child seat 2, the front seat anchor 12 and the rear seat anchor 13 can be substantially aligned with a central axis X of the swinging platform 112 that extends from the rear to the front, which can correspond to the direction of the back and forth swing motion.

Figure 2:
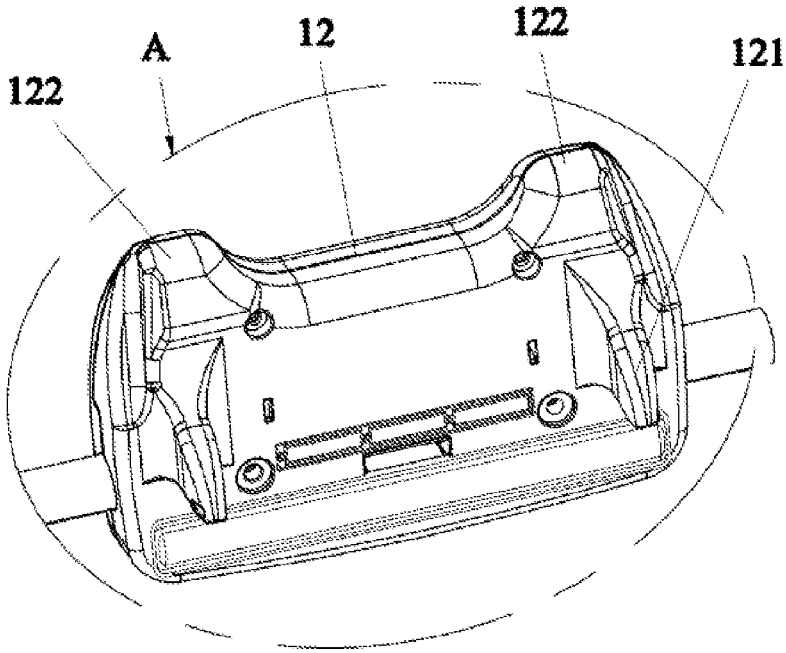
FIG. 2 is an enlarged view of portion A shown in FIG. 1.
Figure 6:
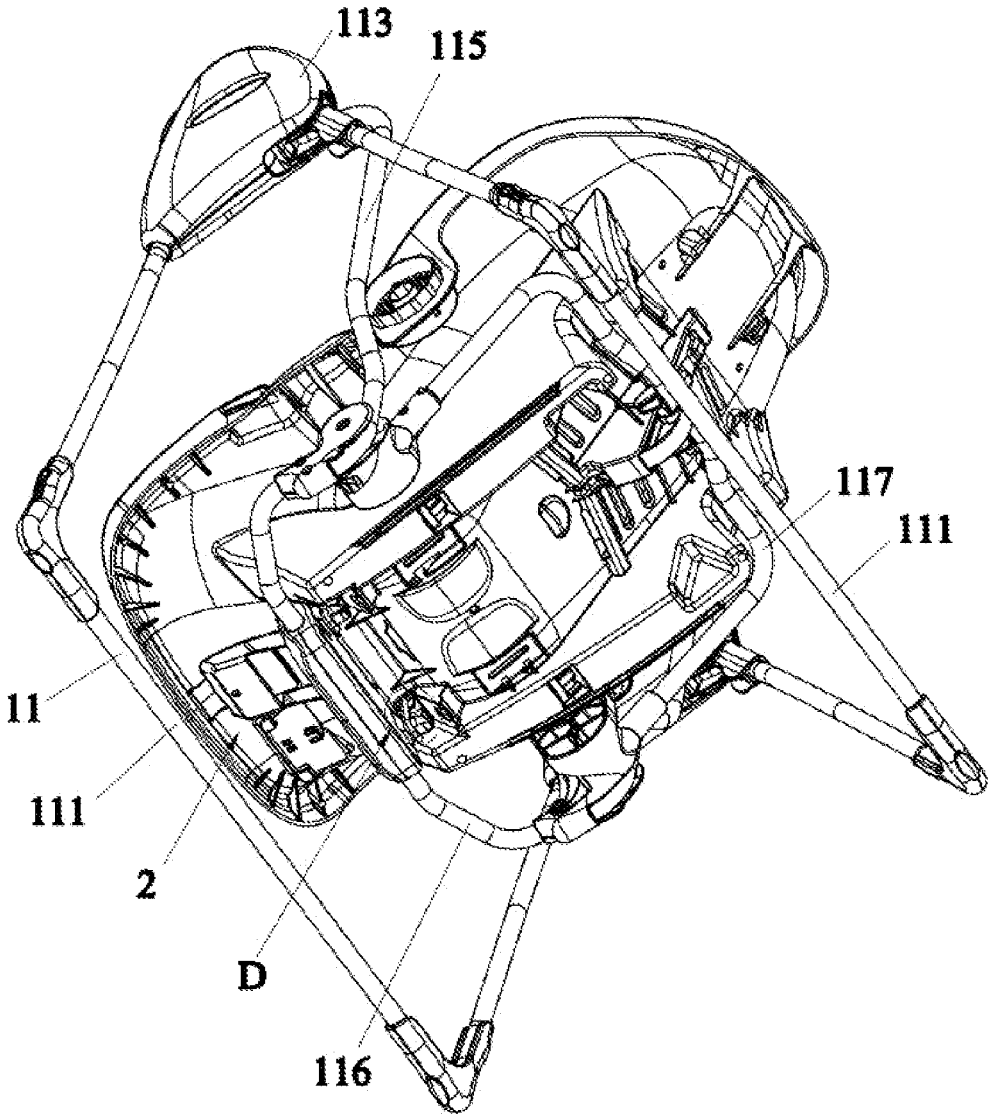
FIG. 6 is a perspective view illustrating one embodiment of assembling a child seat with the swing frame.
Figure 7:
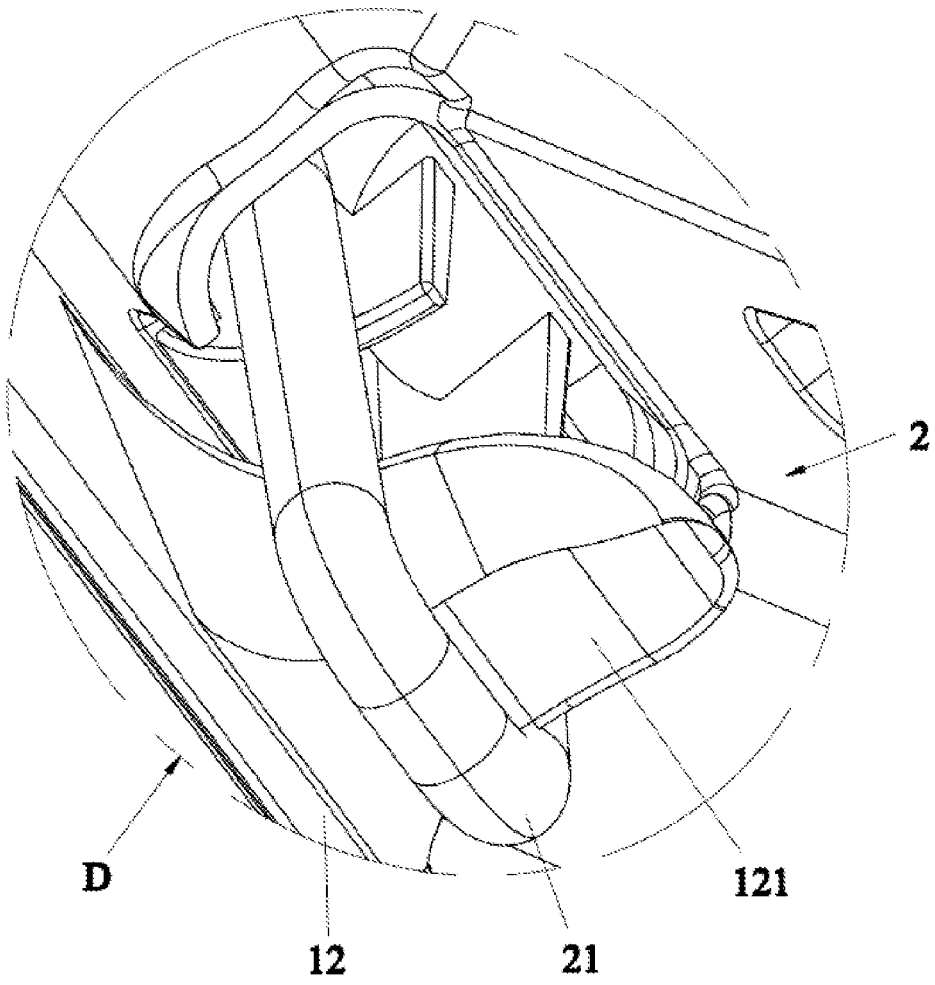
FIG. 7 is an enlarged view of portion D shown in FIG. 6.

Referring to FIGS. 1, 2 and 6, the front seat anchor 12 can be affixed with the first tube segment 116. In one embodiment, the front seat anchor 12 can be integrated with a vibration control box that is operable to impart vibration to the child seat 2. The front seat anchor 12 can include studs 121 protruding toward the central opening 114 that can engage with the child seat 2 to block up and down as well as transversal displacements of the child seat 2 relative to the swinging platform 112. The front seat anchor 12 can also include two prongs 122 protruding upward and adapted to provide resting contact for the child seat 2. When the child seat 2 is installed with the swinging platform 112, the front seat anchor 12 can be located at an underside of the child seat 2 close to its front (i.e., facing a front of the child).

Figure 3:
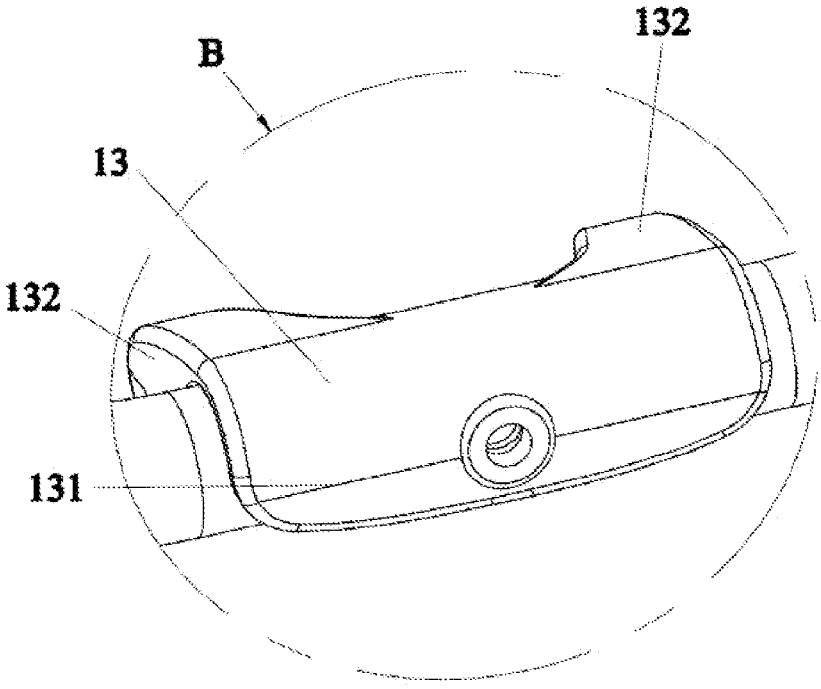
FIG. 3 is an enlarged view of portion B shown in FIG. 1.
Figure 4:
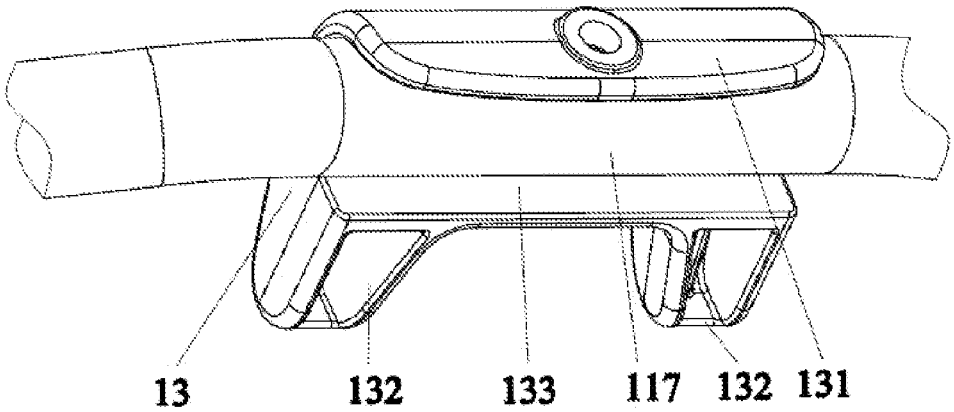
FIG. 4 is a schematic view showing the seat anchor represented in FIG. 3 under another viewing angle.

Referring to FIGS. 3 and 4, the rear seat anchor 13 can be affixed with the second tube segment 117 opposite to the front seat anchor 12. In one embodiment, the rear seat anchor 13 can include a tube mounting portion 131, and two prongs 132 transversally spaced apart from each other and protruding from the tube mounting portion 131 toward the region of the central opening 114. The tube mounting portion 131 can include a slot 131 into which the second tube segment 117 can be inserted and attached with the rear seat anchor 13. When the child seat 2 is installed on the swinging platform 112, the rear seat anchor 13 is located at an underside of the child seat 2 close to its rear (i.e., facing a rear of the child). The rear seat anchor 13 can be configured to block back and forth displacements of the installed child seat 2 relative to the swinging platform 112.

Figure 5:
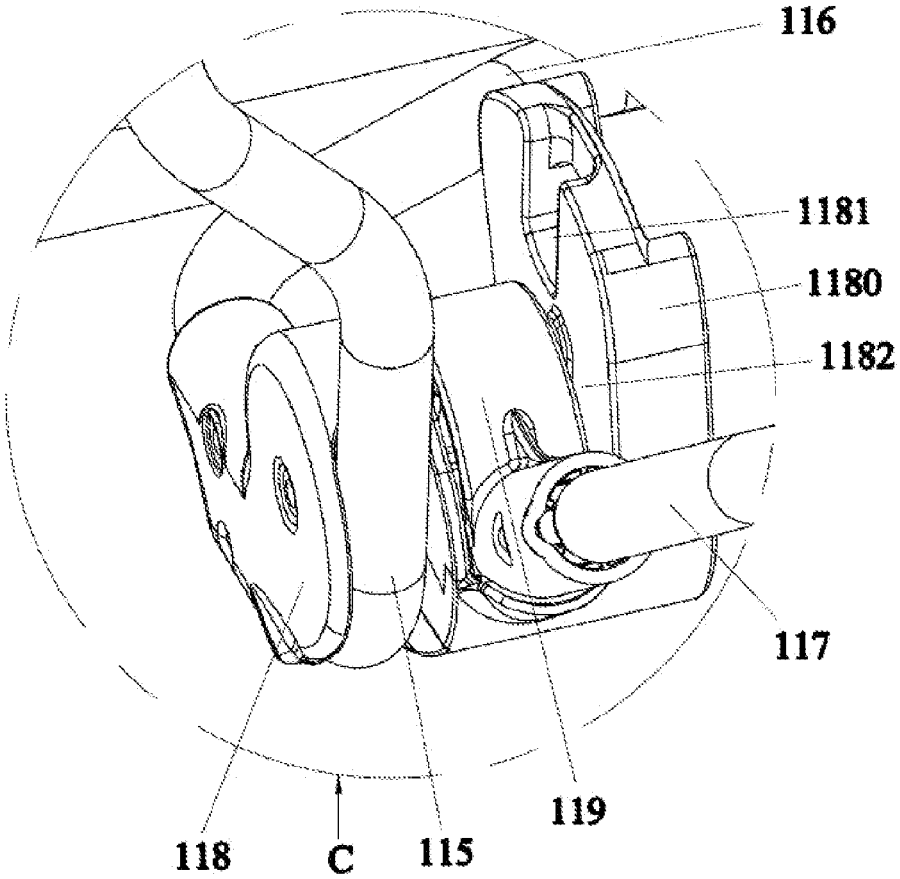
FIG. 5 is an enlarged view of portion C shown in FIG. 1.

Referring to FIG. 5, the lateral seat anchors 1180 can be respectively provided on the joining brackets 118. The seat anchors 1180 can be symmetrically disposed at the left and right sides of the central axis X of the swinging platform 112, and in a region between the front and rear seat anchors 12 and 13. In one embodiment, each seat anchor 1180 can be formed integrally with the joining bracket 118 adjacent to the pocket 1182, and can have a slot 1181. The lateral seat anchors 1180 can provide two attachment points for the child seat 2 at two lateral sides of the swinging platform 112.

FIGS. 6-9 are schematic views illustrating one embodiment of attaching the child seat 2 with the swinging platform 112. The child seat 2 can be held with the swinging platform 112 between the left and right side leg frames 111, an underside of the child seat 2 being at least partially received in the central opening 114. An underside of the child seat 2 near its front can have two catches 21 transversally spaced apart from each other. Each of the catches 21 can be formed as a collar structure through which one corresponding stud 21 of the front seat anchor 12 can engage. The studs 121 of the front seat anchor 12 on the swinging platform 112 can removably engage through the catches 21 so that a front portion of the child seat 2 can be securely held with the swinging platform 112. An underside of the child seat 2 near its rear can have a projecting portion 22, and a hook 23 that may be integrally formed with the projecting portion 22. When the child seat 2 is installed on the swinging platform 112, the projecting portion 22 can be disposed between the two prongs 132 of the rear seat anchor 3, and the hook 23 can at least partially wrap around an underside of the tube mounting portion 131 of the rear seat anchor 13. The engagement of the rear seat anchor 13 with the projecting potion 22 and the hook 23 can accordingly block transversal as well as upward displacements of the child seat 2.

Figure 8:
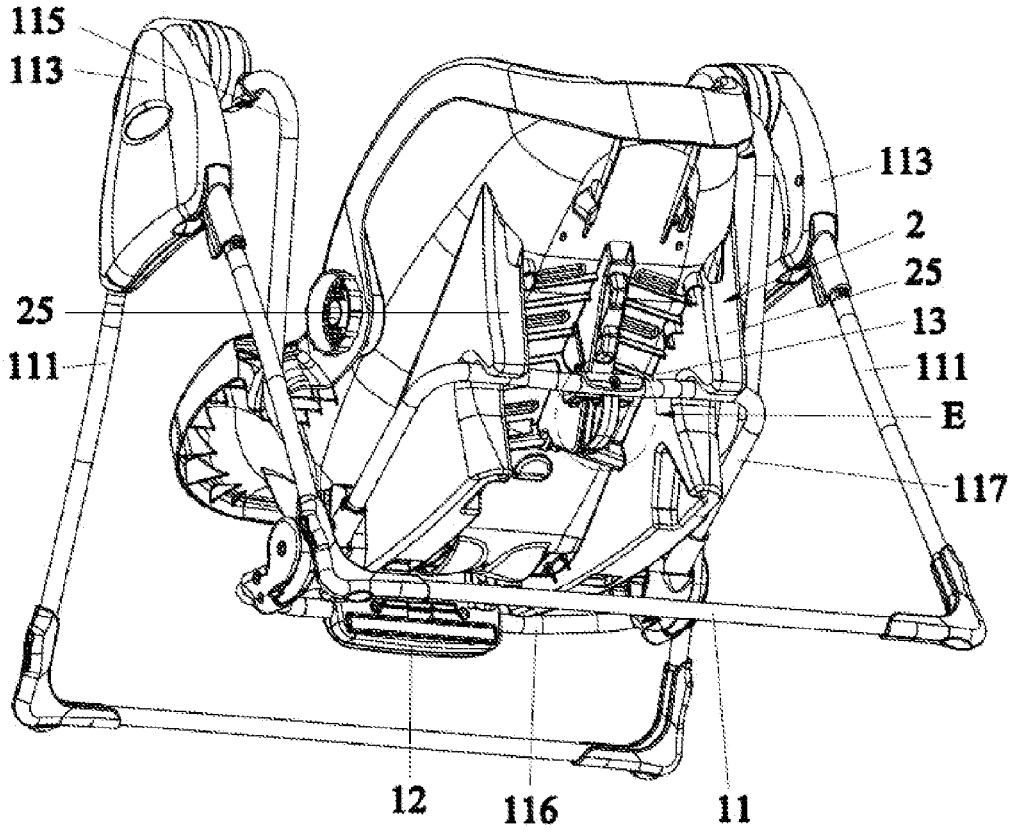
FIG. 8 is view illustrating the assembly of the child seat with the swing frame under another viewing angle.
Figure 9:
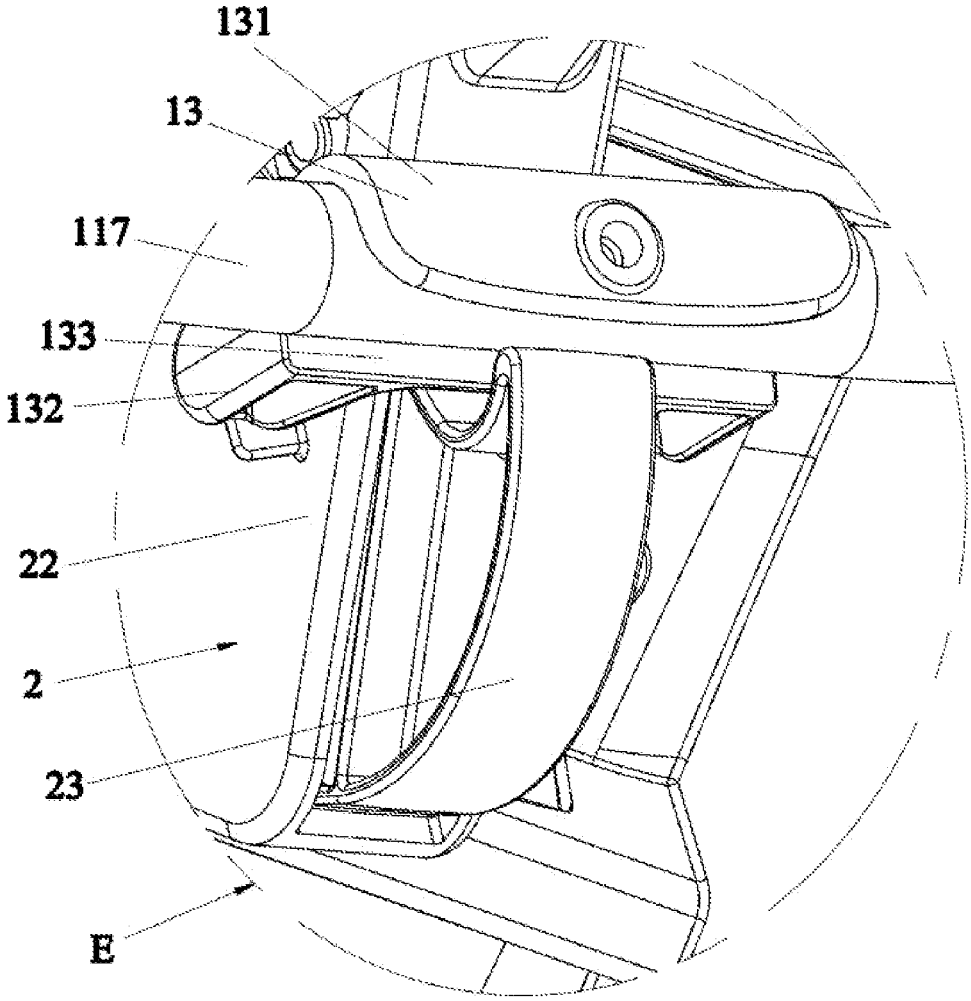
FIG. 9 is an enlarged view of portion E shown in FIG. 8.

Referring to FIG. 8, the underside of the child seat 2 can also include two protruding pillars 25 transversally spaced apart from each other and located at left and right sides of the projecting portion 22. When the child seat 2 is used with a support base (not shown), the pillars 25 can facilitate the placement and support of the child seat 2 on the base. When the child seat 2 is installed on the swinging platform 112, the pillars 25 can rest against the second tube segment 117.

As described previously, the child seat 2 can have coupling structures that can engage with the front and rear seat anchors 12 and 13 to hold the child seat 2 with the swinging platform 112. The seat anchors 12 and 13 can provide two attachment locations at the front and the rear for holding the child seat 2 in place. In alternate embodiments, the child seat 2 can also be held with the swinging platform 112 via different attachment locations.

Figure 10:
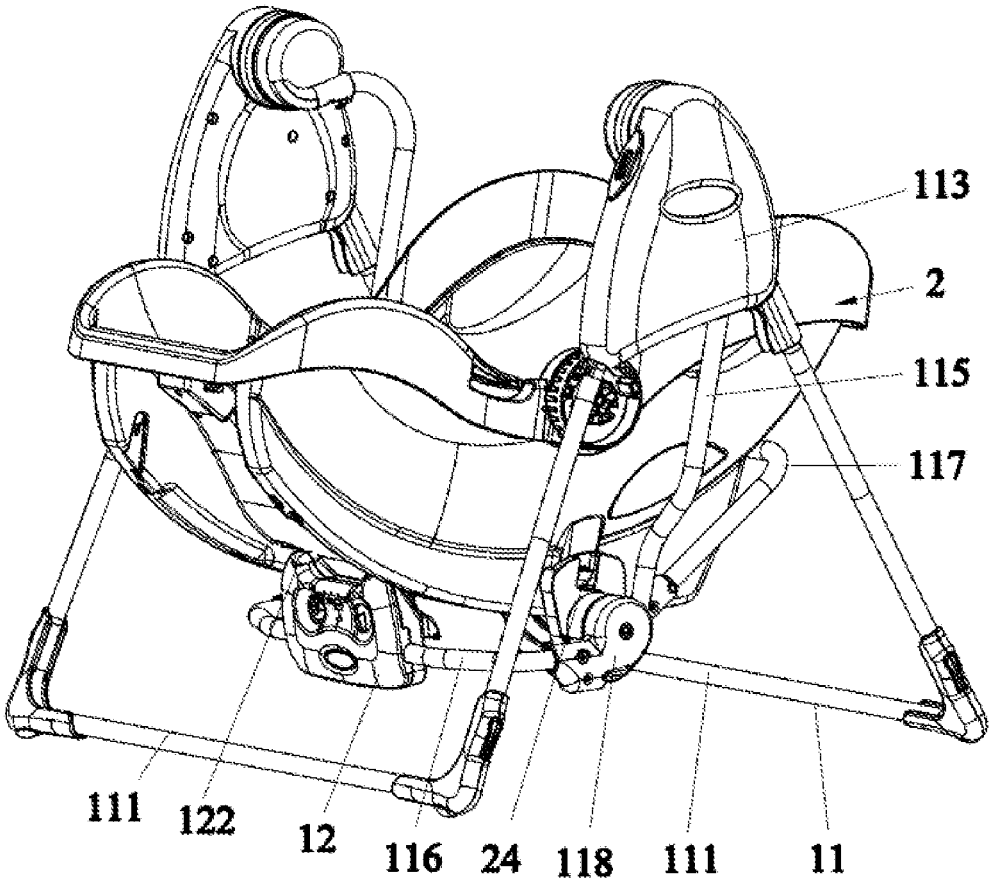
FIG. 10 is a perspective view illustrating another embodiment of assembling the child seat with the swing frame.
Figure 11:
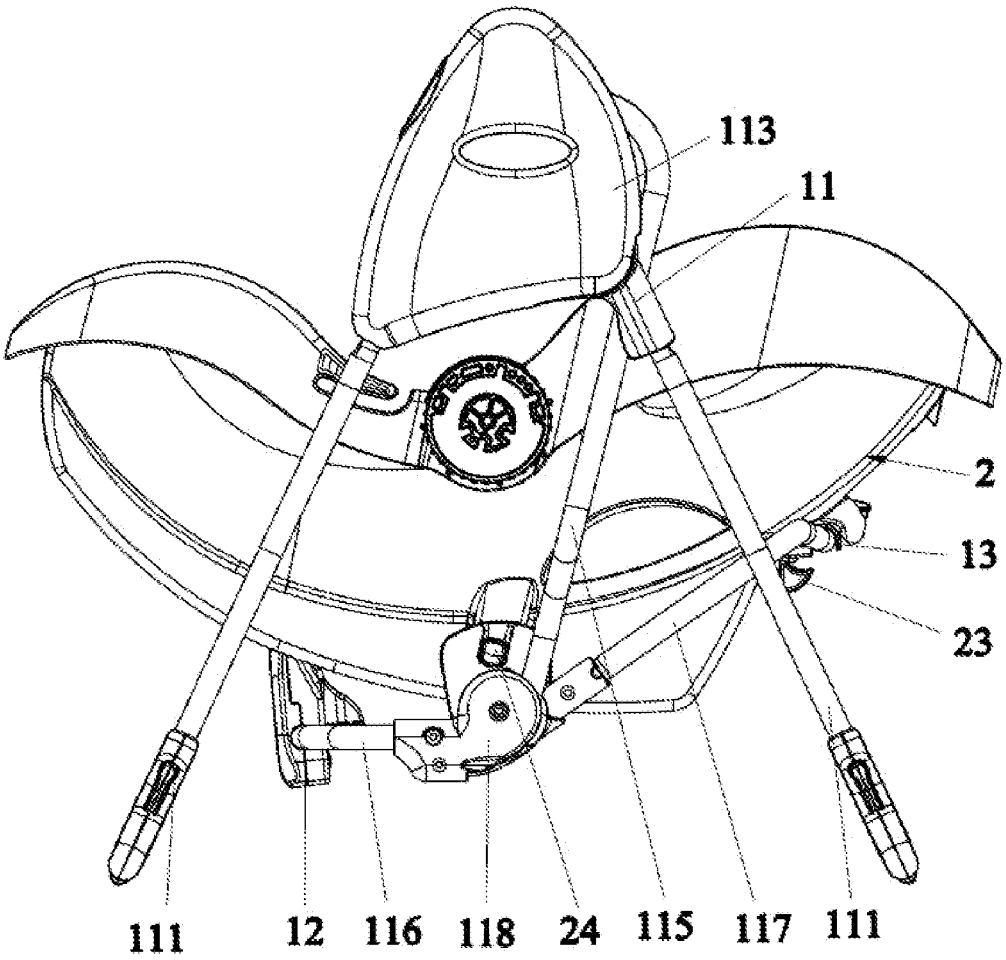
FIG. 11 is a side view of the embodiment represented in FIG. 10.

In conjunction with FIG. 5, FIGS. 10 and 11 are schematic views illustrating another embodiment of attaching the child seat 2 with the swinging platform 112. One difference of the embodiment shown in FIGS. 10 and 11 from the previous embodiment is that each of a left and a right side of the child seat 2 can be respectively provided with a movable latch 24. Moreover, the underside of the child seat 2 does not have the catches 21 described previously. When the child seat 2 is installed on the swinging platform 112, the latches 24 can be spring-driven to protrude laterally and respectively engage with the slots 1181 in the seat anchors 1180 of the joining brackets 118. The engagement of the latches 24 through the slots 1181 may at least block vertical displacement of the child seat 2. Moreover, the hook 23 of the child seat 2 can also engage with the rear seat anchor 13 of the swinging platform 112 like previously described. With this embodiment, the child seat 2 can be held with the swinging platform 112 via three seat anchors, i.e., one seat anchor 13 at the rear of the child seat 2, and two seat anchors 1180 at the left and right sides of the child seat 2.

It will be understood that other embodiments may use any combinations of the seat anchors described herein. For example, one variant embodiment may fasten the child seat with the swinging platform with a front attachment at the front seat anchor 12, and left and right side attachments via the engagement of the latches 24 with the lateral seat anchors 1180. In other variant embodiments, five attachments can be applied to hold the child seat with the swinging platform, including the front and rear attachments via the seat anchors 12 and 13, and left and right side attachments via the lateral seat anchors 1180.

At least one advantage of the structures described herein is the ability to provide multiple attachment methods through which the child seat can be securely held with the swing apparatus. Accordingly, the swing apparatus can be adapted to receive the installation of multiple types of child seats with different attachment systems.

Realizations of the infant swing apparatuses have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the inventions as defined in the claims that follow.

What is claimed is:

1. An infant swing apparatus comprising:

a support structure;

a swinging platform pivotally assembled with the support structure and having a central axis extending from a rear to a front of the swinging platform, the swinging platform being operable to swing back and forth between the rear and the front;

a plurality of seat anchors affixed with the swinging platform, wherein the seat anchors include a first and a second seat anchor disposed substantially aligned with the central axis of the swinging platform, and a third seat anchor located at a side of the central axis and in a region between the first and second seat anchors; and a child seat removably installed with the swinging platform by engaging with at least two ones among the first to third seat anchors.

2. The infant swing apparatus according to claim 1, wherein the swinging platform includes a first tube segment, a second tube segment, and a joining bracket that are assembled together to form a resting support on which the child seat is installed, the first tube segment being affixed with the joining bracket, the joining bracket being provided with the third seat anchor.

3. The infant swing apparatus according to claim 2, wherein the second tube segment is pivotally connected with the joining bracket.

4. The infant swing apparatus according to claim 2, wherein the swinging platform further includes a swing arm having a lower end affixed with the joining bracket, and an upper end pivotally connected with the support structure.

5. The infant swing apparatus according to claim 2, wherein the third seat anchor includes a slot through which a movable latch of the child seat engages to attach the child seat with the swinging platform.

6. The infant swing apparatus according to claim 1, wherein the child seat is held with the swinging platform by respectively engaging with the first and second seat anchors of the swinging platform.

7. The infant swing apparatus according to claim 1, wherein the child seat is held with the swinging platform by respectively engaging with the second and third seat anchors.

8. The infant swing apparatus according to claim 1, wherein the swinging platform defines a central opening adapted to receive at least partially the child seat, and the first seat anchor includes a stud protruding toward the central opening and configured to engage with an underside portion of the child seat.

9. The infant swing apparatus according to claim 1, wherein the swinging platform defines a central opening adapted to receive at least partially the child seat, and the second seat anchor includes two prongs transversally spaced apart, a projecting portion of the child seat being disposed between the two prongs.

10. The infant swing apparatus according to claim 1, wherein the first seat anchor is integrated with a vibration control box operable to impart vibration to the child seat.

11. An infant swing apparatus comprising:

a support structure;

a swinging platform pivotally assembled with the support structure and having a central axis extending from a rear to a front of the swinging platform, the swinging platform being operable to swing back and forth between the rear and the front;

a plurality of seat anchors affixed with the swinging platform, wherein the seat anchors include a first and a second seat anchor disposed substantially aligned with the central axis of the swinging platform, and a third and a fourth seat anchor located at two opposite sides of the central axis and in a region between the first and second seat anchors; and a child seat removably held with the swinging platform by engaging with at least two ones among the first to fourth seat anchors.

12. The infant swing apparatus according to claim 11, wherein the swinging platform includes a central opening adapted to receive at least partially the child seat, the first to fourth seat anchors being disposed around the central opening.

13. The infant swing apparatus according to claim 11, wherein the third and fourth seat anchors are disposed symmetrically at two opposite sides of the central axis.

14. The infant swing apparatus according to claim 11, wherein the swinging platform includes a first tube segment, a second tube segment, and two joining brackets that are assembled together to form a resting support on which the child seat is installed, the first tube segment having two opposite ends respectively affixed with the two joining brackets, the two joining brackets being respectively provided with the third and fourth seat anchors.

15. The infant swing apparatus according to claim 14, wherein the second tube segment is pivotally connected with the joining bracket.

16. The infant swing apparatus according to claim 14, wherein the swinging platform further includes at least one swing arm having a lower end affixed with one of the two joining brackets, and an upper end pivotally connected with the support structure.

17. The infant swing apparatus according to claim 14, wherein each of the third seat anchors includes a slot through which a corresponding latch of the child seat engages to attach the child seat with the swinging platform.

18. The infant swing apparatus according to claim 11, wherein the child seat is held with the swinging platform by respectively engaging with the first and second seat anchors of the swinging platform.

19. The infant swing apparatus according to claim 11, wherein the child seat is held with the swinging platform by respectively engaging with the second, third and fourth seat anchors.

20. The infant swing apparatus according to claim 11, wherein the first seat anchor is integrated with a vibration control box operable to impart vibration to the child seat.

* * * * *